US011788177B2

(12) United States Patent
Majka

(10) Patent No.: US 11,788,177 B2
(45) Date of Patent: Oct. 17, 2023

(54) PRECIPITATION-HARDENED STAINLESS STEEL ALLOYS

(71) Applicant: GENERAL ELECTRIC COMPANY, Schenectady, NY (US)

(72) Inventor: Theodore Francis Majka, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/241,154

(22) Filed: Apr. 27, 2021

(65) Prior Publication Data

US 2022/0341013 A1 Oct. 27, 2022

(51) Int. Cl.

| | |
|---|---|
| ***C21D 6/04*** | (2006.01) |
| ***C22C 38/18*** | (2006.01) |
| ***C21D 6/02*** | (2006.01) |
| ***C22C 38/60*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/52*** | (2006.01) |

(52) U.S. Cl.

CPC ..... *C22C 38/60* (2013.01); *C22C 38/001* (2013.01); *C22C 38/002* (2013.01); *C22C 38/007* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/52* (2013.01)

(58) Field of Classification Search
None
See application file for complete search history.

(56) References Cited

U.S. PATENT DOCUMENTS

| | | | | |
|---|---|---|---|---|
| 3,574,601 | A | 4/1971 | Myers et al. | |
| 6,743,305 | B2 * | 6/2004 | Short | C22C 38/42 148/326 |
| 7,985,306 | B2 * | 7/2011 | Chen | C21D 8/005 420/60 |
| 8,663,403 | B2 | 4/2014 | Chen et al. | |

FOREIGN PATENT DOCUMENTS

| | | | | |
|---|---|---|---|---|
| CN | 101210304 | A | | 7/2008 |
| CN | 105886949 | A | | 8/2016 |
| JP | H08144023 | A | | 6/1996 |
| JP | 108217 | A | * | 1/1998 |
| JP | H108217 | A | | 1/1998 |
| JP | H10219404 | A | | 8/1998 |

OTHER PUBLICATIONS

Effect of Heat treatment and microstructure on the mechanical and corrosion properties of a precipitation hardenable stainless steel Kosa T and DeBold, T, A (Year: 1979).*

European Search Report issued to European counterpart Application No. EP22168138 dated Aug. 18, 2022.

* cited by examiner

*Primary Examiner* — Jenny R Wu

(74) *Attorney, Agent, or Firm* — McNees Wallace & Nurick LLC

(57) ABSTRACT

A precipitation-hardened stainless steel alloy is disclosed including, by weight: 14.0-16.0% Cr; 6.0-7.0% Ni; 1.25-1.75% Cu; 0.5-1.0% Mo; 0.40-0.85% Nb; 0.025-0.05% C; up to 1.0% Mn; up to 1.0% Si; up to 0.1% V; up to 0.1% Co; up to 0.1% Sn; up to 0.02% N; up to 0.025% P; up to 0.05% Al; up to 0.008% S; up to 0.005% Ag; up to 0.005% Pb; up to 0.1% As; up to 0.01% Sb; and a balance of Fe. The alloy has a ratio of Nb:(C+N) of at least 15:1.

19 Claims, 1 Drawing Sheet

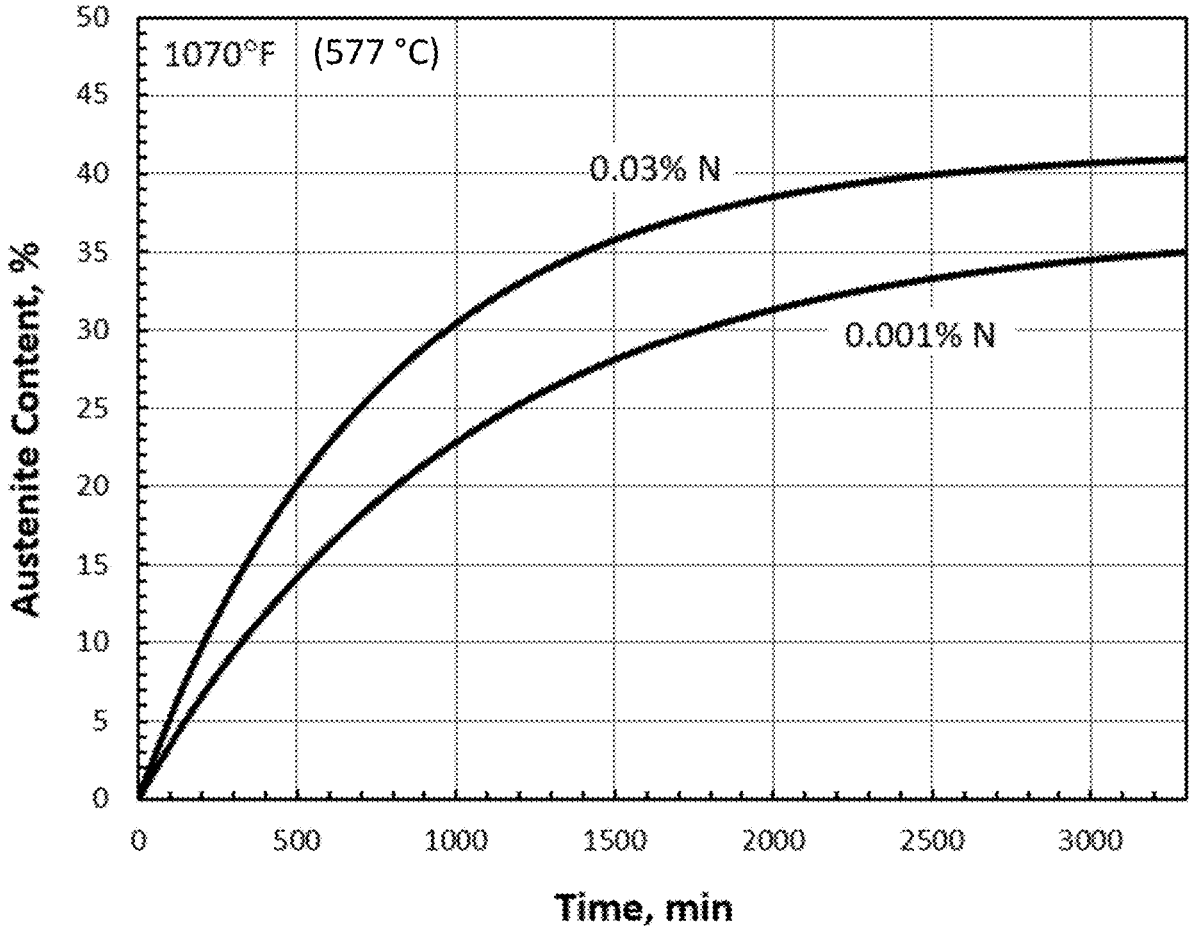
1070°F (577 °C)
0.03% N
0.001% N
Austenite Content, %
Time, min
0
5
10
15
20
25
30
35
40
45
50
0
500
1000
1500
2000
2500
3000

PRECIPITATION-HARDENED STAINLESS STEEL ALLOYS

FIELD

The present disclosure is directed to precipitation-hardened stainless steel alloys. More particularly, the present disclosure is directed to precipitation-hardened stainless steel alloys having a ratio of niobium to carbon and nitrogen combined of at least 15:1.

BACKGROUND

Metal alloys used for components subjected to rigorous operating conditions, such as the rotating components of gas turbine, particularly the compressor airfoils which include rotating blades (buckets) and stationary vanes (nozzles), may require a combination of high strength, toughness, fatigue resistance and other physical and mechanical properties in order to provide the mandatory operational properties of these machines. In addition, the alloys used must also have sufficient resistance to corrosion damage arising from the extreme environments in which turbines are operated, such as exposure to various ionic reactant species including chlorides, sulfates, nitrides, and other corrosive species. Corrosion may also diminish the other physical and mechanical properties, such as high cycle fatigue strength by initiation of surface cracks that propagate under the cyclic thermal and operational stresses associated with operation of a turbine.

Various high strength stainless steel alloys have been proposed to meet these and other requirements, particularly at a cost that permits their widespread use. For example, U.S. Pat. No. 3,574,601 discloses the compositional and other characteristics of a precipitation hardenable, essentially martensitic stainless steel alloy, now known commercially as Carpenter Custom 450, and focuses on corrosion resistance and mechanical properties of this alloy. The Custom 450 alloy contains chromium, nickel, molybdenum, and copper, as well as other potential alloying constituents such as carbon and niobium (columbium), to yield an essentially martensitic microstructure, having small amounts of less than 10% retained austenite and 1-2% or less of delta ferrite. Niobium may be added at a weight ratio of up to 10 times relative to carbon if carbon is present in an amount above 0.03 weight percent.

In further examples, U.S. Pat. No. 6,743,305 describes an improved stainless steel alloy suitable for use in rotating steam turbine components that exhibits both high strength and toughness as a result of having particular ranges for chemistry, tempering temperatures and grain size. U.S. Pat. No. 7,985,306 describes an improved stainless steel alloy suitable for use in rotating gas turbine components, particularly compressor airfoils, which has niobium in an amount greater than twenty and less than twenty-five times the amount of carbon. U.S. Pat. No. 8,663,403 describes an improved stainless steel alloy suitable for use in rotating gas turbine components, particularly compressor airfoils, which has niobium in an amount greater than twenty times the amount of carbon.

While the precipitation hardened, martensitic stainless steels described above have provided corrosion resistance, mechanical strength, and fracture toughness properties suitable for use in rotating steam turbine components, these alloys may be susceptible to intergranular corrosion attack, or may have alloy compositions having undesirable amounts of individual elements which may negatively affect other properties of the alloys.

BRIEF DESCRIPTION

In an exemplary embodiment, a precipitation-hardened stainless steel alloy incudes, by weight: 14.0-16.0% Cr; 6.0-7.0% Ni; 1.25-1.75% Cu; 0.5-1.0% Mo; 0.40-0.85% Nb; 0.025-0.05% C; up to 1.0% Mn; up to 1.0% Si; up to 0.1% V; up to 0.1% Co; up to 0.1% Sn; up to 0.02% N; up to 0.025% P; up to 0.05% Al; up to 0.008% S; up to 0.005% Ag; up to 0.005% Pb; up to 0.1% As; up to 0.01% Sb; and a balance of Fe. The alloy has a ratio of Nb:(C+N) of at least 15:1.

Further aspects of the subject matter of the present disclosure are provided by the following clauses:

A precipitation-hardened stainless steel alloy, comprising, by weight: 14.0-16.0% Cr; 6.0-7.0% Ni; 1.25-1.75% Cu; 0.5-1.0% Mo; 0.40-0.85% Nb; 0.025-0.05% C; up to 1.0% Mn; up to 1.0% Si; up to 0.1% V; up to 0.1% Co; up to 0.1% Sn; up to 0.02% N; up to 0.025% P; up to 0.05% Al; up to 0.008% S; up to 0.005% Ag; up to 0.005% Pb; up to 0.1% As; up to 0.01% Sb; and a balance of Fe, wherein the alloy has a ratio of Nb:(C+N) of at least 15:1.

The precipitation-hardened stainless steel alloy of any preceding clause, comprising, by weight, 0.03-0.05% C.

The precipitation-hardened stainless steel alloy of any preceding clause, wherein comprising, by weight, up to 0.01% N.

The precipitation-hardened stainless steel alloy of any preceding clause, consisting of, by weight: 14.0-16.0% Cr; 6.0-7.0% Ni; 1.25-1.75% Cu; 0.5-1.0% Mo; 0.40-0.85% Nb; 0.025-0.05% C; up to 1.0% Mn; up to 1.0% Si; up to 0.1% V; up to 0.1% Co; up to 0.1% Sn; up to 0.02% N; up to 0.025% P; up to 0.05% Al; up to 0.008% S; up to 0.005% Ag; up to 0.005% Pb; up to 0.1% As; up to 0.01% Sb; up to 0.5% incidental impurities of additional elements; and the balance of Fe, wherein the alloy has the ratio of Nb:(C+N) of at least 15:1.

The precipitation-hardened stainless steel alloy of any preceding clause, consisting of, by weight: 14.0-16.0% Cr; 6.0-7.0% Ni; 1.25-1.75% Cu; 0.5-1.0% Mo; 0.40-0.85% Nb; 0.025-0.05% C; up to 1.0% Mn; up to 1.0% Si; up to 0.1% V; up to 0.1% Co; up to 0.1% Sn; up to 0.02% N; up to 0.025% P; up to 0.05% Al; up to 0.008% S; up to 0.005% Ag; up to 0.005% Pb; up to 0.1% As; up to 0.01% Sb; and the balance of Fe, wherein the alloy has the ratio of Nb:(C+N) of at least 15:1.

The precipitation-hardened stainless steel alloy of any preceding clause, comprising, by weight: 0.025-0.045% C, 0.2-0.5% Mn; 0.2-0.5% Si; up to 0.05% V; up to 0.01% Sn; up to 0.01% N; up to 0.01% P; up to 0.005% S; up to 0.01% As; and up to 0.002% Sb.

The precipitation-hardened stainless steel alloy of any preceding clause, consisting of, by weight: 14.0-16.0% Cr; 6.0-7.0% Ni; 1.25-1.75% Cu; 0.5-1.0% Mo; 0.40-0.85% Nb; 0.025-0.045% C; 0.2-0.5% Mn; 0.2-0.5% Si; up to 0.05% V; up to 0.1% Co; up to 0.01% Sn; up to 0.01% N; up to 0.01% P; up to 0.05% Al; up to 0.005% S; up to 0.005% Ag; up to 0.005% Pb; up to 0.01% As; up to 0.002% Sb; up to 0.5% incidental impurities of additional elements; and the balance of Fe, wherein the alloy has the ratio of Nb:(C+N) of at least 15:1.

The precipitation-hardened stainless steel alloy of any preceding clause, consisting of, by weight: 14.0-16.0% Cr; 6.0-7.0% Ni; 1.25-1.75% Cu; 0.5-1.0% Mo; 0.40-0.85% Nb;

0.025-0.045% C; 0.2-0.5% Mn; 0.2-0.5% Si; up to 0.05% V; up to 0.1% Co; up to 0.01% Sn; up to 0.01% N; up to 0.01% P; up to 0.05% Al; up to 0.005% S; up to 0.005% Ag; up to 0.005% Pb; up to 0.01% As; up to 0.002% Sb; and the balance of Fe, wherein the alloy has the ratio of Nb:(C+N) of at least 15:1.

The precipitation-hardened stainless steel alloy of any preceding clause, wherein the alloy has reduced embrittlement relative to an otherwise identical comparative alloy having more than 0.045% C, more than 0.5% Mn, more than 0.5% Si, more than 0.05% V, more than 0.01% Sn, more than 0.01% N, more than 0.01% P, more than 0.005% S, more than 0.01% As, more than 0.002% Sb, or combinations thereof.

The precipitation-hardened stainless steel alloy of any preceding clause, wherein the alloy has lower fracture appearance transition temperature relative to an otherwise identical comparative alloy having more than 0.045% C, more than 0.5% Mn, more than 0.5% Si, more than 0.05% V, more than 0.01% Sn, more than 0.01% N, more than 0.01% P, more than 0.005% S, more than 0.01% As, more than 0.002% Sb, or combinations thereof.

The precipitation-hardened stainless steel alloy of any preceding clause, wherein the alloy has a reduced susceptibility to intergranular attack on reverted austenite adjacent to grain boundaries relative to an otherwise identical comparative alloy having a comparative ratio of Nb:(C+N) of less than 15:1.

The precipitation-hardened stainless steel alloy of any preceding clause, wherein the alloy forms less reverted austenite during heat treatment relative to an otherwise identical comparative alloy having a comparative ratio of Nb:(C+N) of less than 15:1.

The precipitation-hardened stainless steel alloy of any preceding clause, wherein the alloy has at least 25% less reverted austenite following heat treatment at 577° C. for 500 minutes than an otherwise identical comparative alloy having a comparative ratio of Nb:(C+N) of less than 15:1 following heat treatment at 577° C. for 500 minutes.

The precipitation-hardened stainless steel alloy of any preceding clause, wherein the alloy, following heat treatment at 577° C. for 500 minutes, comprises less than 16% reverted austenite.

The precipitation-hardened stainless steel alloy of any preceding clause, wherein the alloy, following heat treatment at 577° C. for 1,000 minutes, comprises less than 25% reverted austenite.

The precipitation-hardened stainless steel alloy of any preceding clause, wherein the alloy, following heat treatment at 577° C. for 3,000 minutes, comprises less than 35% reverted austenite.

The precipitation-hardened stainless steel alloy of any preceding clause, wherein at least 90% of all C and N in the alloy are sequestered as Nb—C, Nb—N, and Nb—C—N species.

The precipitation-hardened stainless steel alloy of any preceding clause, wherein at least 99% of all C and N in the alloy are sequestered as Nb—C, Nb—N, and Nb—C—N species.

The precipitation-hardened stainless steel alloy of any preceding clause, wherein the ratio of Nb:(C+N) is between 15:1 and 34:1.

The precipitation-hardened stainless steel alloy of any preceding clause, wherein the ratio of Nb:(C+N) is between 15:1 and 28:1.

The precipitation-hardened stainless steel alloy of any preceding clause, wherein the ratio of Nb:(C+N) is between 15:1 and 18:1.

BRIEF DESCRIPTION OF THE DRAWINGS

These and other features, aspects, and advantages of the present subject matter will become better understood when the following detailed description is read with reference to the accompanying drawings in which:

The sole FIGURE is a JMaPro software simulation comparing reverted austenite formation versus time at 577° C. with 0.001% N and 0.03% N content in a GTD 450 stainless steel alloy.

DETAILED DESCRIPTION

Provided are exemplary precipitation-hardened stainless steel alloys. Embodiments of the present disclosure, in comparison to precipitation-hardened stainless steel alloys not utilizing one or more features disclosed herein, have decreased susceptibility to intergranular attack, have decreased formation of reverted austenite, have reduced embrittlement, have lower fracture appearance transition temperature, have increased sequestration of carbon and nitrogen, or combinations thereof.

In one embodiment, a precipitation-hardened stainless steel alloy includes, by weight: 14.0-16.0% Cr; 6.0-7.0% Ni; 1.25-1.75% Cu; 0.5-1.0% Mo; 0.40-0.85% Nb; 0.025-0.05% C; up to 1.0% Mn; up to 1.0% Si; up to 0.1% V; up to 0.1% Co; up to 0.1% Sn; up to 0.02% N; up to 0.025% P; up to 0.05% Al; up to 0.008% S; up to 0.005% Ag; up to 0.005% Pb; up to 0.1% As; up to 0.01% Sb; and a balance of Fe, wherein the alloy has a ratio of Nb:(C+N) of at least 15:1.

In a further embodiment, the precipitation-hardened stainless steel alloy consists of, by weight, 14.0-16.0% Cr; 6.0-7.0% Ni; 1.25-1.75% Cu; 0.5-1.0% Mo; 0.40-0.85% Nb; 0.025-0.05% C; up to 1.0% Mn; up to 1.0% Si; up to 0.1% V; up to 0.1% Co; up to 0.1% Sn; up to 0.02% N; up to 0.025% P; up to 0.05% Al; up to 0.008% S; up to 0.005% Ag; up to 0.005% Pb; up to 0.1% As; up to 0.01% Sb; up to 0.5% incidental impurities of additional elements, alternatively up to 0.4% incidental impurities of additional elements, alternatively up to 0.3% incidental impurities of additional elements, alternatively up to 0.2% incidental impurities of additional elements, alternatively up to 0.1% incidental impurities of additional elements, alternatively up to 0.05% incidental impurities of additional elements, alternatively up to 0.01% incidental impurities of additional elements; and a balance of Fe, wherein the alloy has a ratio of Nb:(C+N) of at least 15:1. Incidental impurities of additional elements may include, but are not limited to, titanium.

In yet a further embodiment, the precipitation-hardened stainless steel alloy consists of, by weight: 14.0-16.0% Cr; 6.0-7.0% Ni; 1.25-1.75% Cu; 0.5-1.0% Mo; 0.40-0.85% Nb; 0.025-0.05% C; up to 1.0% Mn; up to 1.0% Si; up to 0.1% V; up to 0.1% Co; up to 0.1% Sn; up to 0.02% N; up to 0.025% P; up to 0.05% Al; up to 0.008% S; up to 0.005% Ag; up to 0.005% Pb; up to 0.1% As; up to 0.01% Sb; and a balance of Fe, wherein the alloy has a ratio of Nb:(C+N) of at least 15:1.

The ratio of Nb:(C+N) for any of the foregoing embodiments may be any suitable ratio of at least 15:1, such as, but not limited to, a ratio of 15:1 to 34:1, alternatively a ratio of 15:1 to 32:1, alternatively a ratio of 15:1 to 30:1, alternatively a ratio of 15:1 to 28:1, alternatively a ratio of 15:1 to 26:1, alternatively a ratio of 15:1 to 24:1, alternatively a ratio of 15:1 to 22:1, alternatively a ratio of 15:1 to 20:1, alternatively a ratio of 15:1 to 18:1, alternatively a ratio of 15:1 to 17:1, alternatively a ratio of 15:1 to 16:1, alternatively a ratio of 16:1 to 18:1, alternatively a ratio of 17:1 to 19:1, alternatively a ratio of 18:1 to 20:1, or any sub-range or combination thereof.

Austenite may occur in the precipitation-hardened stainless steel alloys of the present disclosure in two forms, retained austenite and reverted austenite. Retained austenite is austenite which survives formation of the precipitation-hardened stainless steel alloy, and is not converted to martensite during the formation process. Retained austenite may be reduced or eliminated from the precipitation-hardened stainless steel alloys by appropriate care in the thermal treatments during formation of the precipitation-hardened stainless steel alloys, or by a post-formation cryogenic thermal treatment. Retained austenite, while undesirable, may, as such, be addressed through conventional methods. Reverted austenite, however, is austenite which forms from martensite during heat treatments or other exposure to heat subsequent to initial formation of the precipitation-hardened stainless steel alloys, and which, following formation, does not revert to martensite upon cooling. Cryogenic treatments and other known methods do not successfully mitigate reverted austenite content, without a full re-solutioning of the alloy. Without being bound by theory, it is believed that reverted austenite is stabilized by the presence of carbon and nitrogen in the alloy, which thereby prevents reverted austenite from converting to martensite. Formation of reverted austenite, particularly adjacent to grain boundaries may increase susceptibility of precipitation-hardened stainless steel alloys to intergranular attack.

The precipitation-hardened stainless steel alloy may have a reduced susceptibility to intergranular attack on reverted austenite adjacent to grain boundaries relative to an otherwise identical comparative alloy having a comparative ratio of Nb:(C+N) of less than 15:1. The precipitation-hardened stainless steel alloy may form less reverted austenite during heat treatment relative to an otherwise identical comparative alloy having a comparative ratio of Nb:(C+N) of less than 15:1. At least 90%, alternatively at least 95%, alternatively at least 98%, alternatively at least 99%, alternatively at least 99.5%, alternatively at least 99.9%, alternatively all, of C and N in the precipitation-hardened stainless steel alloy may be sequestered as Nb—C, Nb—N, and Nb—C—N species.

Referring to the FIGURE, in one embodiment, the precipitation-hardened stainless steel alloy has at least 25% less reverted austenite following heat treatment at 577° C. for 500 minutes than an otherwise identical comparative alloy having a comparative ratio of Nb:(C+N) of less than 15:1 following heat treatment at 577° C. for 500 minutes. The precipitation-hardened stainless steel alloy, following heat treatment at 577° C. for 500 minutes, comprises less than 16% reverted austenite, following heat treatment at 577° C. for 1,000 minutes, comprises less than 25% reverted austenite, and following heat treatment at 577° C. for 3,000 minutes, comprises less than 35% reverted austenite.

The precipitation-hardened stainless steel alloy of any of the foregoing embodiments may have, by weight, up to 0.018% N, alternatively up to 0.016% N, alternatively up to 0.015% N, alternatively up to 0.014% N, alternatively up to 0.012% N, alternatively up to 0.010% N, alternatively up to 0.010% N, alternatively up to 0.008% N, alternatively up to 0.005% N, or any sub-range or combination thereof.

The precipitation-hardened stainless steel alloy of any of the foregoing embodiments may have, by weight, 0.03-0.05% C, alternatively 0.025-0.045% C, alternatively 0.03-0.045% C, alternatively 0.035-0.05% C, alternatively 0.035-0.045% C, alternatively 0.04-0.05% C, alternatively 0.04-0.045% C, alternatively 0.045-0.05% C, or any sub-range or combination thereof.

The precipitation-hardened stainless steel alloy of any of the foregoing embodiments may have, by weight, up to 0.9% Mn, alternatively up to 0.8% Mn, alternatively up to 0.7% Mn, alternatively up to 0.6% Mn, alternatively up to 0.5% Mn, alternatively up to 0.4% Mn, alternatively up to 0.3% Mn, alternatively 0.2-0.5% Mn, alternatively 0.2-0.3% Mn, alternatively 0.3-0.4% Mn, alternatively 0.4-0.5% Mn, or any sub-range or combination thereof.

The precipitation-hardened stainless steel alloy of any of the foregoing embodiments may have, by weight, up to 0.9% Si, alternatively up to 0.8% Si, alternatively up to 0.7% Si, alternatively up to 0.6% Si, alternatively up to 0.5% Si, alternatively up to 0.4% Si, alternatively up to 0.3% Si, alternatively 0.2-0.5% Si, alternatively 0.2-0.3% Si, alternatively 0.3-0.4% Si, alternatively 0.4-0.5% Si, or any sub-range or combination thereof.

The precipitation-hardened stainless steel alloy of any of the foregoing embodiments may have, by weight, up to 0.09% V, alternatively up to 0.08% V, alternatively up to 0.07% V, alternatively up to 0.06% V, alternatively up to 0.05% V, alternatively up to 0.04% V, alternatively up to 0.03% V, alternatively up to 0.02% V, alternatively up to 0.01% V, or any sub-range or combination thereof.

The precipitation-hardened stainless steel alloy of any of the foregoing embodiments may have, by weight, up to 0.09% Sn, alternatively up to 0.08% Sn, alternatively up to 0.07% Sn, alternatively up to 0.06% Sn, alternatively up to 0.05% Sn, alternatively up to 0.04% Sn, alternatively up to 0.03% Sn, alternatively up to 0.02% Sn, alternatively up to 0.01% Sn, alternatively up to 0.005% Sn, alternatively up to 0.001% Sn, or any sub-range or combination thereof.

The precipitation-hardened stainless steel alloy of any of the foregoing embodiments may have, by weight, up to 0.025% P, alternatively up to 0.02% P, alternatively up to 0.015% P, alternatively up to 0.01% P, alternatively up to 0.005% P, alternatively up to 0.001% P, or any sub-range or combination thereof.

The precipitation-hardened stainless steel alloy of any of the foregoing embodiments may have, by weight, up to 0.007% S, alternatively up to 0.006% S, alternatively up to 0.005% S, alternatively up to 0.004% S, alternatively up to 0.003% S, alternatively up to 0.002% S, alternatively up to 0.001% S, or any sub-range or combination thereof.

The precipitation-hardened stainless steel alloy of any of the foregoing embodiments may have, by weight, up to 0.09% As, alternatively up to 0.08% As, alternatively up to 0.07% As, alternatively up to 0.06% As, alternatively up to 0.05% As, alternatively up to 0.04% As, alternatively up to 0.03% As, alternatively up to 0.02% As, alternatively up to 0.01% As, alternatively up to 0.005% As, alternatively up to 0.001% As, or any sub-range or combination thereof.

The precipitation-hardened stainless steel alloy of any of the foregoing embodiments may have, by weight, up to 0.009% Sb, alternatively up to 0.008% Sb, alternatively up to 0.007% Sb, alternatively up to 0.006% Sb, alternatively up to 0.005% Sb, alternatively up to 0.004% Sb, alternatively up to 0.003% Sb, alternatively up to 0.002% Sb, alternatively up to 0.0015% Sb, alternatively up to 0.001% Sb, or any sub-range or combination thereof.

It is specifically disclosed that any of the narrowed ranges of C, Mn, Si, V, Sn, N, P, S, As, and Sb disclosed herein may be combined with the narrowed ranges of the others of these elements in any combination, and that the resulting combinations of ranges may be applied to any of the embodiments of precipitation-hardened stainless steel alloy disclosed herein.

Without limiting the scope of this disclosure, one exemplary precipitation-hardened stainless steel alloy includes, by weight: 14.0-16.0% Cr; 6.0-7.0% Ni; 1.25-1.75% Cu; 0.5-1.0% Mo; 0.40-0.85% Nb; 0.025-0.045% C, alternatively 0.030-0.045% C; 0.2-0.5% Mn; 0.2-0.5% Si; up to 0.05% V; up to 0.1% Co; up to 0.01% Sn; up to 0.01% N; up to 0.01% P; up to 0.05% Al; up to 0.005% S; up to 0.005% Ag; up to 0.005% Pb; up to 0.1% As; up to 0.01% Sb; and a balance of Fe, wherein the alloy has a ratio of Nb:(C+N) of at least 15:1. Another exemplary precipitation-hardened stainless steel alloy consists of, by weight, 14.0-16.0% Cr; 6.0-7.0% Ni; 1.25-1.75% Cu; 0.5-1.0% Mo; 0.40-0.85% Nb; 0.025-0.045% C, alternatively 0.030-0.045% C; 0.2-0.5% Mn; 0.2-0.5% Si; up to 0.05% V; up to 0.1% Co; up to 0.01% Sn; up to 0.01% N; up to 0.01% P; up to 0.05% Al; up to 0.005% S; up to 0.005% Ag; up to 0.005% Pb; up to 0.1% As; up to 0.01% Sb; up to 0.5% incidental impurities of additional elements, alternatively up to 0.4% incidental impurities of additional elements, alternatively up to 0.3% incidental impurities of additional elements, alternatively up to 0.2% incidental impurities of additional elements, alternatively up to 0.1% incidental impurities of additional elements, alternatively up to 0.05% incidental impurities of additional elements, alternatively up to 0.01% incidental impurities of additional elements; and a balance of Fe, wherein the alloy has a ratio of Nb:(C+N) of at least 15:1. Yet another exemplary precipitation-hardened stainless steel alloy consists of, by weight, 14.0-16.0% Cr; 6.0-7.0% Ni; 1.25-1.75% Cu; 0.5-1.0% Mo; 0.40-0.85% Nb; 0.025-0.045% C, alternatively 0.030-0.045% C; 0.2-0.5% Mn; 0.2-0.5% Si; up to 0.05% V; up to 0.1% Co; up to 0.01% Sn; up to 0.01% N; up to 0.01% P; up to 0.05% Al; up to 0.005% S; up to 0.005% Ag; up to 0.005% Pb; up to 0.1% As; up to 0.01% Sb; and a balance of Fe, wherein the alloy has a ratio of Nb:(C+N) of at least 15:1.

In one embodiment, wherein the precipitation-hardened stainless steel alloy includes up to 0.045% C, up to 0.5% Mn, up to 0.5% Si, up to 0.05% V, up to 0.01% Sn, up to 0.01% N, up to 0.01% P, up to 0.005% S, up to 0.01% As, and up to 0.002% Sb, the alloy has reduced embrittlement relative to an otherwise identical comparative alloy having more than 0.045% C, more than 0.5% Mn, more than 0.5% Si, more than 0.05% V, more than 0.01% Sn, more than 0.01% N, more than 0.01% P, more than 0.005% S, more than 0.01% As, more than 0.002% Sb, or combinations thereof.

In one embodiment, wherein the precipitation-hardened stainless steel alloy includes up to 0.045% C, up to 0.5% Mn, up to 0.5% Si, up to 0.05% V, up to 0.01% Sn, up to 0.01% N, up to 0.01% P, up to 0.005% S, up to 0.01% As, and up to 0.002% Sb, the alloy has lower fracture appearance transition temperature relative to an otherwise identical comparative alloy having more than 0.045% C, more than 0.5% Mn, more than 0.5% Si, more than 0.05% V, more than 0.01% Sn, more than 0.01% N, more than 0.01% P, more than 0.005% S, more than 0.01% As, more than 0.002% Sb, or combinations thereof.

While the precipitation-hardened stainless steel alloys have been described with reference to preferred embodiments, it will be understood by those skilled in the art that various changes may be made, and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this technology, but that the present disclosure will include all embodiments falling within the scope of the appended claims.

What is claimed is:

1. A precipitation-hardened stainless steel alloy, comprising, by weight:
14.0-16.0% Cr;
6.0-7.0% Ni;
1.25-1.75% Cu;
0.5-1.0% Mo;
0.65-0.85% Nb;
0.025-0.05% C;
up to 1.0% Mn;
up to 1.0% Si;
up to 0.1% V;
up to 0.1% Co;
up to 0.1% Sn;
up to 0.02% N;
up to 0.01% P;
up to 0.05% Al;
up to 0.008% S;
up to 0.005% Ag;
up to 0.005% Pb;
up to 0.1% As;
up to 0.01% Sb; and
a balance of Fe,
wherein the alloy has a ratio of Nb:(C+N) between 26:1 and 34:1.

2. The alloy of claim 1, comprising, by weight, 0.03-0.05% C.

3. The alloy of claim 1, comprising, by weight, up to 0.01% N.

4. The alloy of claim 1, consisting of, by weight:
14.0-16.0% Cr;
6.0-7.0% Ni;
1.25-1.75% Cu;
0.5-1.0% Mo;
0.65-0.85% Nb;
0.025-0.05% C;
up to 1.0% Mn;
up to 1.0% Si;
up to 0.1% V;
up to 0.1% Co;
up to 0.1% Sn;
up to 0.02% N;
up to 0.01% P;
up to 0.05% Al;
up to 0.008% S;
up to 0.005% Ag;
up to 0.005% Pb;
up to 0.1% As;
up to 0.01% Sb;
up to 0.5% incidental impurities of additional elements; and
the balance of Fe,
wherein the alloy has the ratio of Nb:(C+N) of between 26:1 and 34:1.

5. The alloy of claim 4, consisting of, by weight:
14.0-16.0% Cr;
6.0-7.0% Ni;
1.25-1.75% Cu;
0.5-1.0% Mo;

0.65-0.85% Nb;
0.025-0.05% C;
up to 1.0% Mn;
up to 1.0% Si;
up to 0.1% V;
up to 0.1% Co;
up to 0.1% Sn;
up to 0.02% N;
up to 0.01% P;
up to 0.05% Al;
up to 0.008% S;
up to 0.005% Ag;
up to 0.005% Pb;
up to 0.1% As;
up to 0.01% Sb; and
the balance of Fe,
wherein the alloy has the ratio of Nb:(C+N) of between 26:1 and 34:1.

6. The alloy of claim 1, comprising, by weight:
0.025-0.045% C;
0.2-0.5% Mn;
0.2-0.5% Si;
up to 0.05% V;
up to 0.01% Sn;
up to 0.01% N;
up to 0.005% S;
up to 0.01% As; and
up to 0.002% Sb.

7. The alloy of claim 6, consisting of, by weight:
14.0-16.0% Cr;
6.0-7.0% Ni;
1.25-1.75% Cu;
0.5-1.0% Mo;
0.65-0.85% Nb;
0.025-0.045% C;
0.2-0.5% Mn;
0.2-0.5% Si;
up to 0.05% V;
up to 0.1% Co;
up to 0.01% Sn;
up to 0.01% N;
up to 0.01% P;
up to 0.05% Al;
up to 0.005% S;
up to 0.005% Ag;
up to 0.005% Pb;
up to 0.01% As;
up to 0.002% Sb;
up to 0.5% incidental impurities of additional elements; and
the balance of Fe,
wherein the alloy has the ratio of Nb:(C+N) of between 26:1 and 34:1.

8. The alloy of claim 7, consisting of, by weight:
14.0-16.0% Cr;
6.0-7.0% Ni;
1.25-1.75% Cu;
0.5-1.0% Mo;
0.65-0.85% Nb;
0.025-0.045% C;
0.2-0.5% Mn;
0.2-0.5% Si;
up to 0.05% V;
up to 0.1% Co;
up to 0.01% Sn;
up to 0.01% N;
up to 0.01% P;
up to 0.05% Al;
up to 0.005% S;
up to 0.005% Ag;
up to 0.005% Pb;
up to 0.01% As;
up to 0.002% Sb; and
the balance of Fe,
wherein the alloy has the ratio of Nb:(C+N) of between 26:1 and 34:1.

9. The alloy of claim 6, wherein the alloy has reduced embrittlement relative to an otherwise identical comparative alloy having more than 0.045% C, more than 0.5% Mn, more than 0.5% Si, more than 0.05% V, more than 0.01% Sn, more than 0.01% N, more than 0.01% P, more than 0.005% S, more than 0.01% As, more than 0.002% Sb, or combinations thereof.

10. The alloy of claim 6, wherein the alloy has lower fracture appearance transition temperature relative to an otherwise identical comparative alloy having more than 0.045% C, more than 0.5% Mn, more than 0.5% Si, more than 0.05% V, more than 0.01% Sn, more than 0.01% N, more than 0.01% P, more than 0.005% S, more than 0.01% As, more than 0.002% Sb, or combinations thereof.

11. The alloy of claim 1, wherein the alloy has a reduced susceptibility to intergranular attack on reverted austenite adjacent to grain boundaries relative to an otherwise identical comparative alloy having a comparative ratio of Nb:(C+N) of less than 15:1.

12. The alloy of claim 1, wherein the alloy forms less reverted austenite during heat treatment relative to an otherwise identical comparative alloy having a comparative ratio of Nb:(C+N) of less than 15:1.

13. The alloy of claim 1, wherein the alloy has at least 25% less reverted austenite following heat treatment at 577° C. for 500 minutes than an otherwise identical comparative alloy having a comparative ratio of Nb:(C+N) of less than 15:1 following heat treatment at 577° C. for 500 minutes.

14. The alloy of claim 1, wherein the alloy, following heat treatment at 577° C. for 500 minutes, comprises less than 16% reverted austenite.

15. The alloy of claim 1, wherein the alloy, following heat treatment at 577° C. for 1,000 minutes, comprises less than 25% reverted austenite.

16. The alloy of claim 1, wherein the alloy, following heat treatment at 577° C. for 3,000 minutes, comprises less than 35% reverted austenite.

17. The alloy of claim 1, wherein at least 90% of all C and N in the alloy are sequestered as Nb—C, Nb—N, and Nb—C—N species.

18. The alloy of claim 17, wherein at least 99% of all C and N in the alloy are sequestered as Nb—C, Nb—N, and Nb—C—N species.

19. The alloy of claim 1, comprising, by weight, 0.3-0.5% Mn.

* * * * *